US006993252B1

(12) United States Patent
Dasgupta et al.

(10) Patent No.: US 6,993,252 B1
(45) Date of Patent: Jan. 31, 2006

(54) SELF-MONITORING FLOW-THROUGH HEATER

(75) Inventors: Purnendu K. Dasgupta, Lubbock, TX (US); Ellis L. Loree, Albuquerque, NM (US)

(73) Assignee: Global FIA, Inc., Gig Harbor, WA (US)

( * ) Notice: Subject to any disclaimer, the term of this patent is extended or adjusted under 35 U.S.C. 154(b) by 41 days.

(21) Appl. No.: 10/709,627

(22) Filed: May 18, 2004

(51) Int. Cl.
*A45D 20/10* (2006.01)

(52) U.S. Cl. ..... 392/385; 219/497

(58) Field of Classification Search ..... 219/497; 392/485, 486
See application file for complete search history.

(56) References Cited

U.S. PATENT DOCUMENTS 2,716,179 A * 8/1955 Cornella ..... 392/468
6,080,973 A * 6/2000 Thweatt, Jr. ..... 219/497

OTHER PUBLICATIONS

Norio Teshima et al., "Catalytic decomposition of hydrogen peroxide by a flow-through self-regulating platinum black heater," Analytica Chimica Acta, 510 (2004), 9-13.
Purnendu K. Dasgupta et al., "An Energy-Efficient Self-Regulating Heater for Flow-Through Applications," Anal. Chem. 2003, 75, 3924-3928.

* cited by examiner

*Primary Examiner*—Thor S. Campbell
(74) *Attorney, Agent, or Firm*—Reginald F. Roberts, Jr.

(57) ABSTRACT

A self-monitoring flow-through heater. The heater has a wire inside a tube, and the wire heats and monitors the temperature of a fluid flowing through the tube. The wire has a high specific resistivity and a high temperature coefficient of resistance, so that monitoring the voltage across and/or the current flowing through the wire measures the mean temperature of the wire and of the fluid in the tube.

3 Claims, 4 Drawing Sheets

SELF-MONITORING FLOW-THROUGH HEATER

BACKGROUND OF INVENTION

The present invention relates to chemical analysis. More specifically, the invention relates to instrumental chemical analysis.

In many experiments a flow-through heating arrangement is needed to reduce reaction time. Often the reaction conditions require inertness of the wetted material. Heated reactors based on polymeric tubing, notably polytetrafluoroethylene (PTFE), are the most common, and such reactors are typically used in a manner in which the reactors are immersed in a heated bath or an otherwise thermally conductive potting in which a heater and a temperature sensor are also immersed for heating and temperature control. Polymeric tubes are poor conductors of heat; hence most reactors of this type have very poor utilization of thermal energy. The present invention provides much more efficient energy utilization.

SUMMARY OF INVENTION

In general, the present invention provides a self-monitoring flow-through heater, comprising (a) a passageway providing a flow conduit; and (b) a wire disposed in the passageway, for heating and monitoring the temperature of a fluid flowing through the passageway. The wire has a high specific resistivity and a high temperature coefficient of resistance, so that monitoring voltage across and/or current through the wire measures the mean temperature of the wire and thereby indirectly of the fluid in the passageway.

DETAILED DESCRIPTION

Figure 1A:
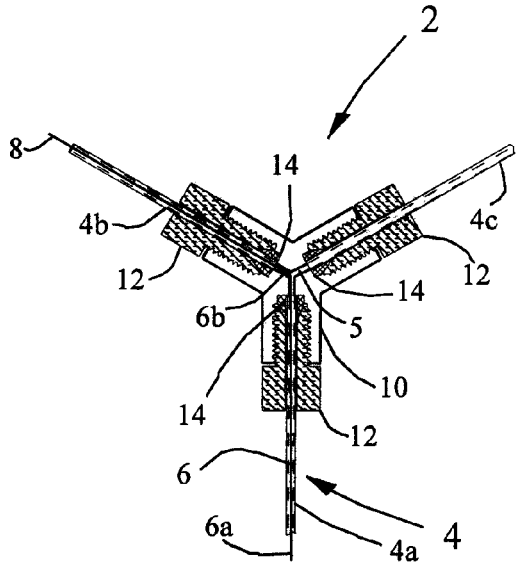
FIG. 1A is a schematic representation of a self-monitoring flow-through heater, made in accordance with the principles of the present invention.

More specifically, reference is made to FIG. 1A, in which is shown a self-monitoring flow-through heater, made in accordance with the principles of the present invention, and generally designated by the numeral 2. The flow-through heater 2 comprises a tube 4 having an unbranched portion 4*a* and branches 4*b* and 4*c*. A wire 6 having a first end 6*a* and a second end 6*b* extends through the unbranched portion 4*a* and into the branch 4*b* of the tube 4, where it connects to an electrical cable 8. The branch 4*c* of the tube 4 provides an inlet for a fluid 5 to the tube 4, which is secured to a housing 10 by threaded inserts 12 and caps 14. Tube end 4*a* and wire end 6*a* terminate at the other end in an identical arrangement (not shown) as FIG. 1A where wire 6 exits in a fluid-leak free manner and connects to an electrical cable, and a separate outlet port is provided for the fluid to be connected to detectors or other optional equipment.

Figure 1B:
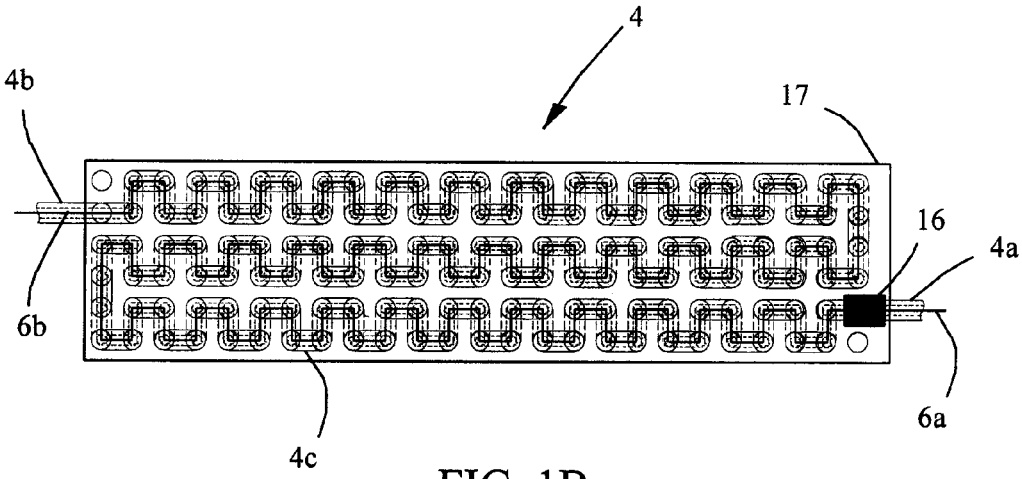
FIG. 1B is a schematic representation of a tube shown in FIG. 1A, and of a temperature sensor.

Reference is now made to FIG. 1B, in which is shown the tube 4 and an external temperature sensor 16. The temperature sensor 16 is disposed outside the tube 4, near the fluid exit end (not shown) of the wire 6, on a stainless-steel screen 17, for independent measurement of the temperature indicated and controlled by the wire 6. The tube 4 is coiled in a Serpentine-2 pattern comprising a plurality of coils 4*c* on the screen 17, which holds the serpentine pattern in a fixed geometry.

Figure 2:
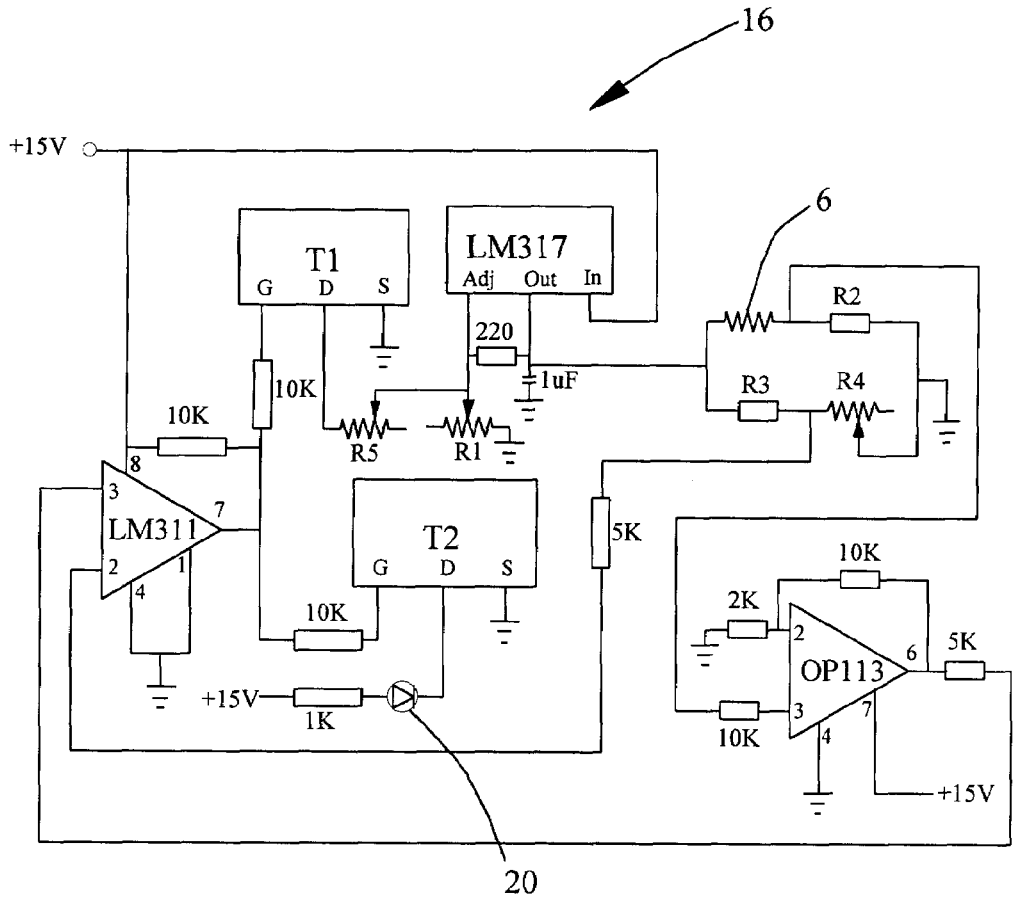
FIG. 2 is a wiring diagram of the self-monitoring flow-through heater shown in FIG. 1A.

Reference is now made to FIG. 2, in which is shown a wiring diagram that allows wire 6 to be used as a temperature-controlled heater wherein it serves both as the heater and the temperature sensor. In series with the wire 6 is a current-sensing resistor R2. At constant voltage applied by a voltage regulator LM317 and a first potentiometer R1, the voltage drop across the resistor R2 is directly proportional to the current flowing through wire 6, which is functioning as the heater. Because the resistance of the wire 6 increases with increasing temperature, the sensed voltage across the resistor R2 decreases as the temperature increases, wire 6 thus behaving as a sensor. The voltage sensed across the resistor R2 is amplified by an operational amplifier OP113 operated in non-inverting mode with a modest gain of e.g. six. The amplified voltage is compared with a set-temperature voltage generated by an adjustable voltage divider comprising a fixed resistor R3 and a second potentiometer R4 by a comparator LM311. When the amplified sensed voltage drops below the set voltage, the set temperature is reached and the comparator LM311 goes high, turning on a first switch T1 and providing an additional path to ground for the voltage regulator LM317 through a third potentiometer R5, thus lowering the output voltage of the voltage regulator LM317 applied to wire 6. This action is also registered by turning on a light-emitting diode 20 through a second switch T2. The voltage applied to the wire 6 thus swings between two adjustable values controlled by the potentiometers R1 and R5. The potentiometers R1 and R5 can be individually adjusted to provide very accurate temperature control.

The wire 6 may or may not be electrically insulated with respect to contact with the fluid 5. In certain cases, e.g. with a bare platinum wire, reactions taking place in the fluid 5 may be catalyzed by the surface of the wire 6. Preferably, the exterior of the tube 4 is thermally insulated, e.g. by being wrapped with foam sheeting, so that the energy efficiency of heating the fluid 5 in the tube 4 is near unity, making it especially suitable for applications where energy efficiency is critical, such as portable instruments that depend on battery power. Such an arrangement also provides a very compact design for a heated, flow-through reactor.

The wire 6 should have an appreciable temperature coefficient of resistance; viz., greater than about two-tenths percent per degree Centigrade, so that monitoring voltage across and/or current through the wire 6 measures the average resistance of the wire 6, which is proportional to the mean temperature of the wire 6 and of the fluid 5 in the tube 4. This arrangement provides effective temperature control with essentially instantaneous response, and eliminates the need for an additional temperature sensor/controller, since the wire 6 is both a heater and a temperature-sensing element. The wire 6 should also have an appreciable specific resistivity; viz., greater than about one-half ohm-meters. Metals which meet these requirements include, e.g., platinum, nickel, tungsten, and iron-nickel alloys, specifically an alloy of thirty percent iron and seventy percent nickel by weight.

Preferably, very fine wires, e.g. less than or about one-hundred micrometers in diameter, are used. Wires of this diameter are possible because of the cooling effect of the fluid 5 flowing through the tube 4. It is often difficult to insert such fine wires through the tube 4. A convenient method is to insert a Nylon monofilament through the tube 4. The wire 6 is then attached to the filament by cyanoacrylate adhesive, or an opening is drilled into the end of the filament and the wire 6 attached by hooking it to the filament through the opening. The wire 6 is then pulled through the opening. At the end 6*b* of the wire 6 a small amount of insulation, if present, is removed, and the end of the wire 6 is soldered, using a minimum amount of solder, or spot-welded to a much thicker lead wire or electrical cable 8, which is connected to a source of electrical power. A sleeve of soft polymeric tubing, e.g. polyalkene, ethylenechlorotrifluoroethylene, fluorinated ethylene-propylene copolymer, or polytetrafluoroethylene, of about one and one-half millimeters outside diameter, is put over the joint and compression-sealed with polymeric ferrules. For polyalkene or ethylenechlorotrifluoroethylene tubing, it is also possible to melt-seal the tubing around the joint by applying heat. The wire joint can also be sealed in glass.

Construction based on a bifilar wire is somewhat simpler. At one end insulation is removed from the two wires, and the wires are joined together. The exposed area is then covered by a thermally-cured polyimide coating; e.g., Pyralin, a registered trademark of E.I. DuPont de Nemours Corporation. The wire 6 is then inserted, joined end first, to the desired length in the tube 4. The bifilar wire 6 is brought out through a compression-sealed polymer sleeve, as described above. The two components of the bifilar wire 6 are separated before being connected individually to lead wires or electrical cables 8.

The tube 4, with the wire 6 disposed therein, is woven into a Serpentine-2 pattern on the stainless-steel screen 17. After the weaving is completed on the screen 17, the free ends 4*a* and 6*a* of the tube 4 and the wire 6 are connected to another three-port fitting (not shown), identical to that in FIG. 1A. The mesh size of the screen 17 is determined by the outside diameter of the tube 4. The temperature sensor 16 is beneficially an Analog Devices AD-590, used only to monitor, not to control, the temperature, which is controlled entirely by the elements shown in FIG. 2. A simple two-point resistance-temperature calibration of the wire 6 was conducted by immersing the entire flow-through heater 2 in ice-water and in boiling water.

The invention will now be illustrated by the following examples, which are to be construed as exemplary only, and as in no way limiting the scope of the invention.

Figure 3A:
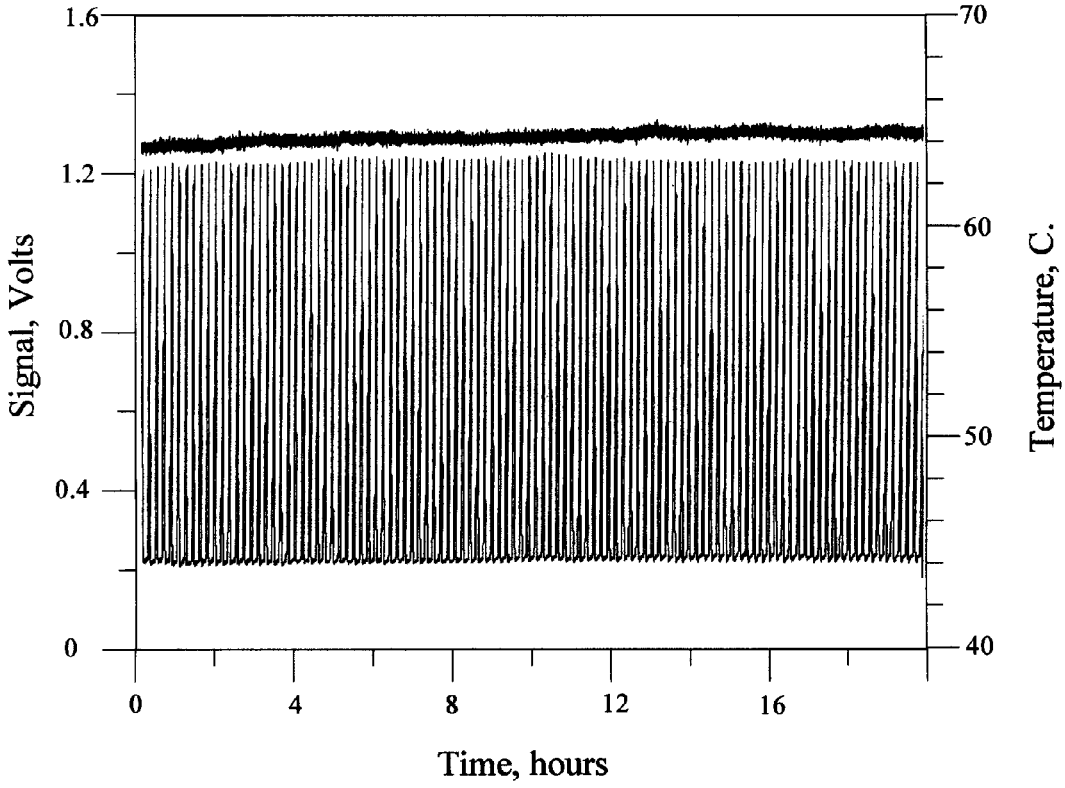
FIG. 3A is a graph of signal response as a function of retention time for a determination of formaldehyde.

Example I Results using the self-monitoring flow-through heater 2 for formaldehyde are shown in FIG. 3A. A water solution having a formaldehyde concentration of three micromoles per liter was automatically injected every ten minutes over a period of eighteen hours. The temperature as monitored by the external temperature sensor 16 is also plotted in FIG. 3A. Based on the mean resistance of the wire 6, insulated Balco wire made from an alloy comprising thirty percent iron and seventy percent nickel by weight, it was found that placing the sensor 16 at this point registers a temperature close to that of the mean temperature of the fluid 5 in the tube 4. The external temperature sensor 16 is placed near the fluid exit (not shown), where the temperature is the highest. However, because the external sensor 16 reads a lower temperature than the element of fluid 5 closest to the sensor 16, the sensor 16 reads a temperature closer to the mean temperature of the fluid 5 inside the tube 4. Both the analytical peak response and the unsmoothed sensor 16 output are displayed. The rate of flow through the tube 4 was one-hundred-seventy-five microliters per minute, and the residence time in the tube 4 was one and four-tenths minutes. With a mean fluid temperature of sixty-five degrees Centigrade, the reaction time was not quite long enough for complete reaction in this particular reaction example. As such, differences in temperature show up as variations in peak response. It is to be observed that the uniformity of peak response is very good; i.e., a relative standard deviation of fifty-seven one-hundredths of a percent. This is equal to or better than the reproducibility previously observed with a system utilizing a commercial temperature sensor and controller. The unfiltered temperature data shown in FIG. 3A have an average value of sixty-four and eighty-seven one-hundredths plus or minus forty one-hundredths of a degree Centigrade. When testing the same chemistry by using a bare platinum wire, we made the interesting observation that the background fluorescence signal goes up substantially, presumably due to the electrooxidation of one of the reagent components to carbonyl compounds. It is interesting to note that the extent of this background increase is dependent on the polarity of the applied voltage with respect to direction of fluid flow. When the fluid exit end (not shown) of the wire 6 was made the positive terminal, the background signal was increased substantially more than when the fluid exit end of the wire 6 was made the negative terminal. A plausible explanation is that, in the latter case, some of the product formed by electrooxidation near the entrance was actually reduced back at the cathodic exit end. When a minor modification of the circuit shown in FIG. 2 was used to apply sixty Hertz alternating current via a relay, rather than direct current, no such elevated background signal was observed, confirming that the artifact was indeed due to electrochemical processes.

Figure 3B:
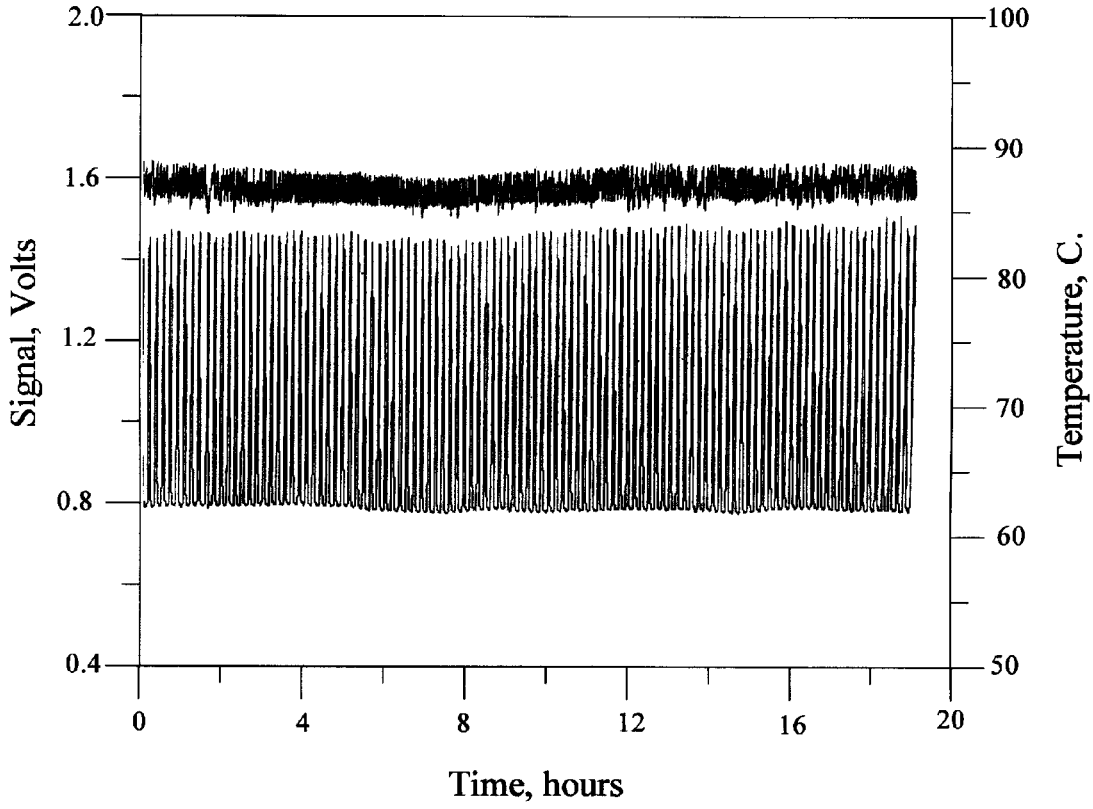
FIG. 3B is a graph of signal response as a function of retention time for a determination of ammonia.

Example II FIG. 3B shows corresponding data for ammonia. The same wire 6 as in Example I was used. The sample was a water solution containing ten micromoles of ammonium ion per liter. The external temperature sensor was a photodiode detector (not shown). In this example the flow-through heater 2 was pushed to the boiling point of the liquid. The mean fluid temperature was about eighty-seven degrees Centigrade, and the final exit temperature was very close to the boiling point of the solution. Residence time in the flow-through heater 2 was one and sixty-seven one-hundredths minutes, and the flow rate was one-hundred-and-fifty microliters per minute. These conditions are reflected in a substantially higher standard deviation of the mean fluid temperature; viz., eighty-six and ninety-one one-hundredths plus or minus ninety-one one-hundredths degrees Centigrade for the unfiltered data. The photodiode detector used in this example has a poorer signal-to-noise ratio for low analyte levels than the photomultiplier tube detector used in Example I. The relative standard deviation in this example was two and four-tenths of a percent.

In summary, what has been disclosed and described herein is a small-volume, flow-through, self-sensing, self-regulating heated reactor that is easily constructed and is more energy efficient than any state-of-the-art device. It should be feasible to utilize the same general principle for heating miniature chip-scale systems.

While certain specific embodiments, examples, and details of construction have been utilized hereinabove to illustrate the present invention, it will be apparent to those skilled in the art that many modifications are possible within the scope of the invention.

What is claimed is:

1. A self-monitoring flow-through heater, comprising:

(a) a passageway providing a flow conduit;

(b) a wire disposed in the passageway for heating and monitoring temperature of a fluid flowing through the tube; the wire having a high temperature coefficient of resistance, so that monitoring voltage across and/or current through the wire measures mean temperature of the wire and thereby indirectly of the fluid in the passageway;

(c) a current-sensing first resistor, the resistor being electrically connected in series with the wire;

(d) a voltage regulator and a first potentiometer, for applying a constant voltage across the wire, voltage drop across the first resistor being directly proportional to the current flowing through the wire, the sensed voltage across the resistor decreasing as the mean temperature of the wire increases, the wire thereby functioning as a temperature sensor;

(e) an operational amplifier, for amplifying the voltage sensed across the first resistor;

(f) an adjustable voltage divider comprising a fixed second resistor, a second potentiometer, and a comparator, for comparing the amplified voltage with a set-temperature voltage generated by the adjustable voltage divider; and (g) a first switch, to provide an additional path to ground for the voltage regulator through a third potentiometer, when the set temperature is reached and the comparator goes high, turning on the first switch, thereby lowering the output voltage applied to the wire by the voltage regulator, whereby the voltage applied to the wire lies between two adjustable values controlled by the first and third potentiometers.

2. The self-monitoring flow-through heater of claim 1, further comprising:

(h) a light-emitting diode; and (i) a second switch;

for registering point at which the set temperature is reached.

3. A self-monitoring flow-through heater, comprising:

(a) a passageway providing a flow conduit; and (b) a straight bare platinum wire disposed in the passageway, for heating and monitoring temperature of a fluid flowing through the passageway, and for catalyzing chemical reactions that are catalyzed by platinum; the wire having a high temperature coefficient of resistance, so that monitoring voltage across and/or current through the wire measures mean temperature of the wire and thereby indirectly of the fluid in the passageway; the wire being coaxially disposed in the passageway, to provide a minimum operating volume.

* * * * *